US005806283A

United States Patent [19]

Shafer

[11] Patent Number: 5,806,283

[45] Date of Patent: Sep. 15, 1998

[54] VACUUM PACKAGING OF PLASTIC BLENDS

[76] Inventor: Richard A. Shafer, 760 Oak Ridge Rd., Dyersburg, Tenn. 38024

[21] Appl. No.: 631,787

[22] Filed: Apr. 12, 1996

[51] Int. Cl.[6] ..... B65B 31/04

[52] U.S. Cl. ..... 53/434; 53/474

[58] Field of Search ..... 206/219, 221, 206/568, 524.8, 524.1; 53/474, 434

[56] References Cited

U.S. PATENT DOCUMENTS

| | | | |
|---|---|---|---|
| Re. 34,929 | 5/1995 | Kristen . | |
| 2,862,616 | 12/1958 | Capozzi et al. | 206/219 |
| 3,489,271 | 1/1970 | Tissot | 206/568 |
| 3,580,390 | 5/1971 | Shull, Jr. | 53/474 X |
| 3,653,499 | 4/1972 | Richter | 206/568 |
| 3,731,791 | 5/1973 | Fourcade et al. | 53/474 X |
| 3,756,388 | 9/1973 | Murphy | 206/568 X |
| 4,055,672 | 10/1977 | Hirsch et al. . | |
| 4,081,560 | 3/1978 | Ishigaki . | |
| 4,576,285 | 3/1986 | Goglio . | |
| 4,637,197 | 1/1987 | Banfield | 53/474 X |
| 4,667,453 | 5/1987 | Goglio . | |
| 4,705,174 | 11/1987 | Goglio . | |
| 4,730,439 | 3/1988 | Chung et al. . | |
| 5,072,830 | 12/1991 | Nielsen . | |
| 5,204,230 | 4/1993 | Hayashi . | |
| 5,217,854 | 6/1993 | Abe . | |
| 5,273,801 | 12/1993 | Barry et al. . | |
| 5,314,069 | 5/1994 | Nielsen . | |
| 5,370,221 | 12/1994 | Magnusson et al. . | |
| 5,445,275 | 8/1995 | Curley et al. . | |

FOREIGN PATENT DOCUMENTS

| | | |
|---|---|---|
| 0 196 551 | 10/1986 | European Pat. Off. . |

*Primary Examiner*—Bryon P. Gehman

[57] ABSTRACT

A homogeneous dry mechanical blend of freely flowable pellets, granules or powders comprising plastic resin and/or plastic additive concentrates is vacuum packaged in order to lock the constituents of the blend in place and eliminate their segregation due to differences in specific gravity, size and shape. The vacuum packaged composition remains immobilized until the vacuum package is opened and the vacuum is released. Thus, the homogeneity of the blend is maintained during shipping, handling and storage. Providing a homogeneous customized mechanical blend of plastic compounded additive concentrates is an economical and preferred method of providing an intermediate product to a user for the molding or extruding of a plastic end product.

1 Claim, 1 Drawing Sheet

VACUUM PACKAGING OF PLASTIC BLENDS

BACKGROUND OF THE INVENTION

When processing polymers for commercial use, a number of compounds are normally added to the polymer to alter its properties and/or to enhance processability. Formulations of additives for compounding of the polymer frequently include one or more reinforcing fillers, pigments, antioxidants, plasticizers, fire retardants, stabilizers, lubricants, wetting agents, biocides, odorants, and the like. Varying the mix of compounding ingredients can produce a wide variety of intermediate plastic products, each customized according to the requirements of a user who then utilizes the intermediate product to mold or extrude the plastic end product.

The customized intermediate product may take several different forms including, for example, a fully compounded plastic material "press-ready" for re-melting and molding or extruding by the user; a single dry "masterbatch" concentrate containing the desired additives compounded with a partial quantity of polymer resin, to which the user then adds the remaining quantity of resin; or a supply of individual additive concentrates, each compounded with a partial quantity of polymer resin, the dry individual concentrates then being measured and blended with the remaining quantity of resin by the user according to the desired recipe. The intermediate products are generally supplied in pellet, granule or powder form.

There are several problems associated with these current methods of producing and supplying the intermediate products. A well-recognized problem is the increased cost involved in producing small lots of customized compounds compared with the cost of producing large lots. Thus, it is much more expensive to produce the small-lot press-ready and masterbatch products than it is to produce large lots of individual concentrates and to supply small bulk quantities of these concentrates for later measuring and blending by the user. However, supplying small bulk quantities to the user also requires a frequently prohibitive investment in blending equipment on the part of the user. Furthermore, even with blending equipment, users frequently fail to correctly measure or blend the individual bulk concentrates, resulting in inconsistent end product quality from batch to batch.

An alternative solution for economically producing and supplying the intermediate product is to produce large quantities of stock individual concentrates and, from these, to supply small quantities of customized intermediate products that are dry mechanical mixtures or blends of the stock concentrates in the desired premeasured proportions, so further blending of the concentrates by the user is not required. However, as described below, this solution has not heretofore proved to be feasible with blends of concentrates that are dissimilar in one or more properties, such as specific gravity, pellet shape, and the like. For example, supplied dry pelletized or powdered plastic blends of concentrates are usually delivered by the user directly from the shipping container into a molding or extruding machine by a suctioning wand or other means. To provide consistency in the proportion and volume of each concentrate delivered to the machine for each batch would require that the supplied mechanical blend of concentrates be entirely homogeneous throughout the container.

Maintaining homogeneity of a dry blend of differing concentrates during shipping, handling and/or storage, however, is virtually impossible because the mechanically flowable pellets, granules and/or powders of the blend settle and become stratified over time according to their differing specific gravities, pellet or particle shapes, and pellet or particle sizes. Thus, for example, small pellets and/or powders tend to migrate to the bottom of the container while larger pellets tend to move to the top. Further, pellets of certain shapes, such as cylindrical pellets, tend to mutually hinder movement with respect to each other, whereas others, such as spherical pellets do not. Thus, spherical pellets tend to migrate to the bottom of the container. Moreover, the degree to which a given concentrate becomes packed in the blend, i.e., the bulk density, depends to a large degree on the shape and size of the given particles or pellets. With respect to the foregoing, and given the vast number of different concentrates that may be produced, providing mechanical blends of two or more concentrates that are close to identical with respect to specific gravity, pellet shape and pellet size is unrealistic.

Therefore, there is a need for a process of reliably maintaining a homogeneous dry mechanical blend of flowable plastic pellets, granules, and/or powdered concentrates during shipping, handling and/or storage. There is a further need for a process of reliably maintaining a homogeneous mechanical blend of plastic pellets, granules, and/or powdered concentrates having differing specific gravities, differing pellet or particle shapes, differing pellet or particle sizes and, therefore, differing bulk densities. Moreover, there is a need for supplying a homogeneous dry mechanical blend of the concentrates in predetermined proportions and/or premeasured quantities, so as not to require further blending and/or measuring by the user.

SUMMARY OF THE INVENTION

The present invention meets the aforementioned needs by providing vacuum packaging of a homogeneous dry mechanical blend of differing plastic concentrates and/or other compounds in pellet, granule and/or powder form. The vacuum locks the blend of pellets and/or particles in place in a flexible package under negative pressure, so that separation and/or settling of unlike pellets or particles is prevented until the vacuum is released. Thus, by the present invention, the homogeneity of the blend is maintained during shipping, handling and/or storage. The invention further provides for maintaining the homogeneity of a blend of compounded plastic concentrates having differing specific gravities, differing pellet or particle shapes, differing pellet or particle sizes and, therefore, differing bulk densities. Thus, the invention provides an economical and feasible solution for producing and supplying individual plastic compound concentrates in predetermined proportions and/or premeasured quantities in the homogeneous blend, so that further blending and/or measuring of the concentrates by the user is not required, and the resulting end products may be of uniform quality from batch to batch.

The vacuum packaged composition of the invention comprises a substantially homogeneous dry blend of at least two different compounds contained and immobilized in an evacuated chamber of a sealed bag. At least one of the compounds comprises a polymer resin and may further comprise polymer resin that has been compounded with an additive to form an additive-resin concentrate. Another of the compounds may similarly comprise a different plastic resin or a different additive-resin concentrate. The compounds may be pellets, granules, powders, and mixtures of these, and they differ from each other in one or more of the physical properties of specific gravity, shape, and size. By the process of the invention, the bag is evacuated of air and other gases and sealed, preferably by heat, thereby immobilizing the homogeneous mixture of the differing compounds in order to maintain the homogeneity of the mixture. The material from which the bag comprising the vacuum package is manufactured is selected to be flexible, chemically inert to the compounds, and physically strong enough to avoid tearing by abrasion against the pellets or particles. Preferably, the bag has at least one gas barrier layer, such as nylon, ethyl vinyl alcohol (EVOH) or aluminum foil, and/or a moisture barrier layer, such as aluminum foil or polypropylene. The outer layers of the bag are preferably manufactured from a material, such as polyethylene, which is heat sealable.

DETAILED DESCRIPTION OF THE INVENTION

Figure 1:
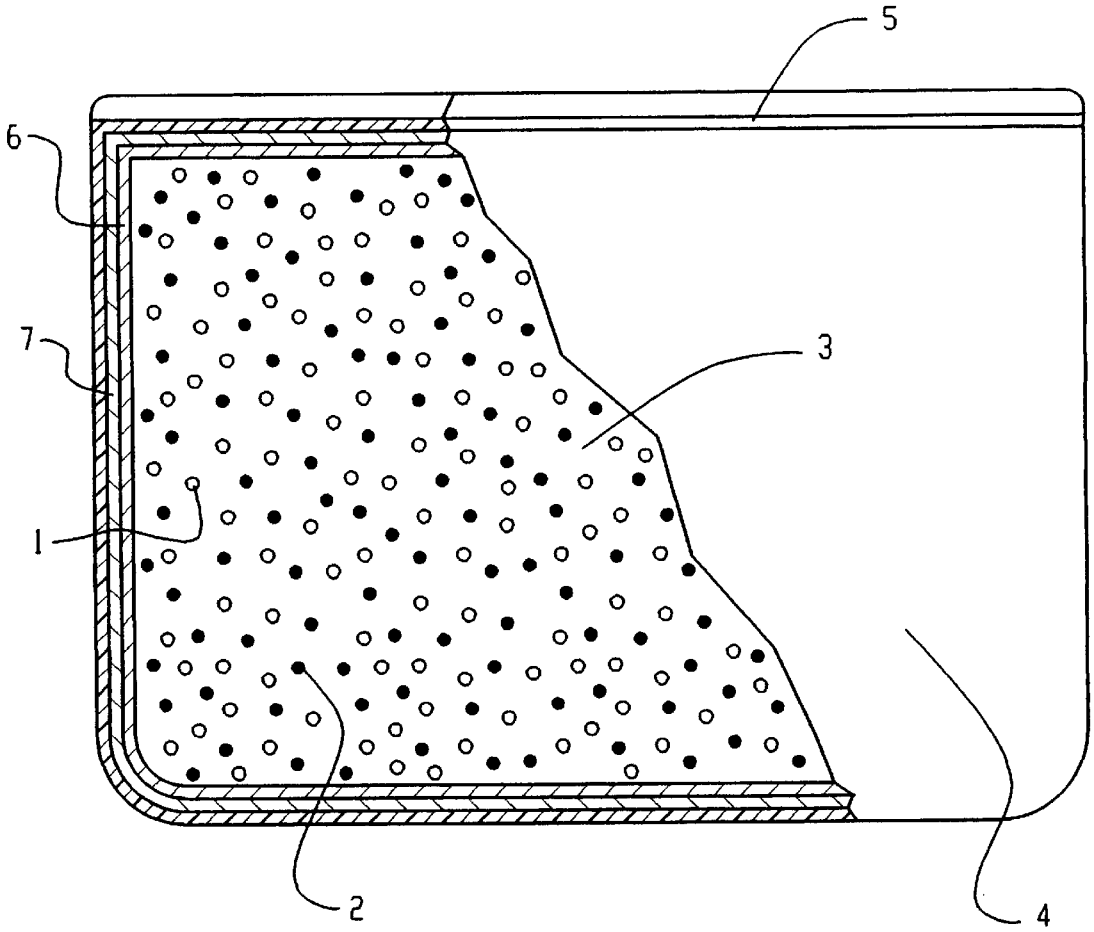
FIG. 1 is a cut-away schematic illustration of the vacuum package containing the homogeneous plastic blend of the invention.

According to the invention, a homogeneous dry blend of freely flowable plastic resins and/or plastic additive concentrates, in the form of pellets, granules and/or powders, is vacuum packaged in order to lock the constituents of the blend in place and eliminate their segregation due to differences in pellet specific gravity, pellet or particle size, pellet or particle shape and, therefore, bulk densities. The vacuum packaged composition remains immobilized until the vacuum package is opened and the vacuum is released. Upon opening of the package, the composition is still freely flowable, and suitable for delivery from the package directly into molding or extruding equipment, such as by a suction wand or similar means.

Providing a customized mechanical blend of plastic compounded additive concentrates is an economical and preferred method of providing an intermediate product to a user for the molding or extruding of a plastic end product. Moreover, the blend is preferably homogeneous in order to deliver the precise proportion of ingredients to the molder or extruder for obtaining plastic end products that are of consistent and uniform quality from batch to batch.

The manufacture of pelletized plastic additive concentrates is known in the art. In general, one or more compounds are added to a small amount of polymer resin in a processing mixer. The mixture is then heated to melting, by known methods, and extruded into spaghetti-like strands. The strands are then cut into a multiplicity of individual plastic pellets, each of which is actually a concentrate of the additive in a small amount of polymer. Alternatively, plastic pellets comprising polymer resin only, without additives, may be similarly manufactured.

The ratio of compound to polymer resin may be varied, as desired. For example, one type of pellet of plastic concentrate may comprise 75% calcium carbonate filler and 25% polypropylene (concentrate "A"). A different type of pellet may comprise 80% flame-retardant compound (for example, if used for electrical applications) and 20% polypropylene (concentrate "B"). Yet another different type of pellet may comprise 5% pigment and 95% polypropylene (concentrate "C"). The pellet concentrates A, B and C may then be mechanically mixed in the desired proportions to form a customized homogeneous blend of concentrates, the remaining proportion of resin to be later added by the user. Alternatively, the concentrates may be proportionately premixed with pellets comprising 100% polypropylene to form a complete homogeneous customized blend. A typical blend may comprise any number of concentrates and/or resins in any proportion as, for example, a blend comprising 20% pellet concentrate A, 5% pellet concentrate B, 5% pellet concentrate C, with or without the remaining 70% resin pellets.

Some additives in the blend may not be compounded with resin but may be loose, such as powders that may be dusted on plastic pellets. For example, in the manufacture of molded structural foam, a blowing agent is used to produce the foam in order to reduce the weight of the end product and to minimize imperfections. Such a blowing agent may be in powder form and, when incorporated into the plastic pellet blend, coats the pellets with powder. Other loose additives may be granular, such as granular plastic resins, or powdery, such as plastic pellets that have been ground into a powder form. Additives such as these would also be added in a desired proportion as part of the blend.

The plastic pellets, as manufactured above, may be of differing sizes and shapes that are dependent upon the type of equipment used for extruding and cutting the strands. The specific gravities of the pellets vary with the resin or resin-additive combination used. Further, the proportion of each type of pellet in the blend depends upon the proportion called for in the customized recipe for the end product. Thus, the proportion of pigment concentrate pellets in the bulk of the pellet blend may be quite small, whereas the proportion of pellets containing a filler concentrate or a lubricant concentrate may be relatively large. In addition, powdered or granular compounds incorporated into the blend may differ in particle size, particle shape and specific gravity and, therefore bulk density.

All of the above factors influence the degree of segregation of the components of the blend. For example, a filler concentrate comprising 75% calcium carbonate and 25% polypropylene would have a specific gravity of about 1.8; a concentrate comprising 5% pigment and 95% polypropylene would have a specific gravity of about 1.0; and a pellet comprising polypropylene alone would have a specific gravity of about 0.9. A mixture of these three concentrates would result in settling of the filler concentrate to the bottom of the container during shipping and handling. Some flame retardant concentrates have specific gravities of up to 3.0 and tend to settle particularly quickly to the bottom the container during handling.

The plastic concentrate pellets, granules and/or powders described above may be mechanically mixed together in the desired customized proportions by any method that will produce a substantially homogeneous free-flowing mixture suitable for vacuum packaging.

Polymer resins that may employed in the vacuum packaged blend of the invention include, but are not limited to, polypropylene, polyethylene, polyvinyl chloride, polyvinyl fluoride, polyolefin, polystyrene, acrylonitrile butadiene styrene, acetal, polyamide, polyamideimide, polyarylate, polycarbonate, polyester, polyetheretherketone, polyetherimide, polyimide, polyphenylene ether, polyphenylene sulfide, polysulfone, and mixtures and copolymers thereof.

Polymer compounding additive substances that may be employed in the vacuum packaged blend of the invention include, but are not limited to mineral and/or reinforcing fillers, color pigments, antioxidants, plasticizers, flame retardants, impact modifiers, nucleating agents, lubricants, wetting agents, ultraviolet stabilizers, biocides, heat stabilizers, odorants, deodorants, antistatic agents, coupling agents, antifogging agents, thickening agents, blowing agents, curing agents, promoters, and mixtures thereof.

Suitable mineral fillers include, but are not limited to, mica, talc, barium sulfate, zinc oxide, wollastonite (calcium silicate), clay and calcium carbonate. Suitable reinforcing fillers include, but are not limited to, glass fibers, glass beads, ceramic fibers, such as boron nitride, high temperature thermoplastics, such as polyethyletherketone (PEEK), or aromatic polyamides, such as Kevlar.

As illustrated in FIG. 1, the homogeneous mechanical blend of plastic compounding compositions for use in the present invention comprises a substantially homogeneous mixture of at least two dissimilar compounds (1, 2). At least one of the compounds comprises a polymer resin alone or a polymer resin compounded with an additive substance. A second compound may comprise an additive substance alone or the additive substance compounded with a polymer resin different from the first, or the same or a different polymer resin compounded with a differing additive substance. The compounds may be pellets, granules, powders, and mixtures of these, and they differ from each other in one or more of the physical properties of specific gravity, shape, and size. Preferably, the blend to be vacuum packaged is freely flowable, as described above.

According to the process of the invention, the homogeneous blend of the first and second compounds is introduced into a chamber (3) in a bag (4) suitable for vacuum packaging. The bag (4) is preferably a flexible bag and the bag and its contents are preferably supported by suitable means (not shown) during vacuum packaging. For example, the support may be a box suitable for use as a shipping container. The bag (4) and its contents are then evacuated of air and other gases by known methods. Evacuation may be to any vacuum sufficient to immobilize the blend but not sufficient to induce tearing of the bag material by abrasion against the pellets or particles. A suitable vacuum for purposes of the invention will depend upon the characteristics of the blend and the bag material, and may be between about 5 and about 29.5 inches of mercury, preferably about 25 inches of mercury. After evacuation, the bag (4) is sealed, preferably by heat, to immobilize the homogeneous blend of the compounds in the chamber of the bag. The vacuum in the bag, and, therefore, the locking of the blend in place, remains until the vacuum is released by opening the bag. Thus, the homogeneity of the blend is maintained in the evacuated bag throughout shipping, handling and/or storage of the package. Preferably, the blend is processed immediately, to prevent later settling and/or segregation of the blend constituents.

The bag (4) may be manufactured of any material known in the art that is suitable for vacuum packaging, chemically compatible with the blend and physically resistant to potential tearing on contact with the plastic pellets. For example, a heavy gauge polyethylene is known in the art to provide such physical resistance. The bag (4) may be constructed of one material layer, or of more than one layer of dissimilar materials. Preferably, the bag comprises a heat-sealable layer (5), at least one gas barrier layer (6) and may also comprise a moisture barrier layer (7). A moisture barrier layer (7) is preferable when plastics comprising hygroscopic resins, such as nylon, are included in the blend. In the absence of such a moisture barrier, these resins can absorb moisture from the atmosphere through the vacuum bag while vacuum packaged. A suitable moisture barrier layer (7) may comprise polypropylene or aluminum foil, the foil also acting as a gas barrier layer (6). A suitable heat-sealable layer (5) may be polyethylene; however, polyethylene is known to be unsuitable as a moisture barrier. A suitable bag (4) for use in the invention may thus be, for example, a layer of aluminum foil or polypropylene coated on both sides by a layer of polyethylene. When several layers of materials are used, a "tie" layer may bridge the differing layers so that the layers stick to each other. For example, a sticky elastomeric layer may be required between a nylon layer and a polyethylene layer. Such vacuum packaging bags and bag materials are generally known in the art.

While the invention has been described herein with reference to the preferred embodiments, it is to be understood that it is not intended to limit the invention to the specific forms disclosed. On the contrary, it is intended to cover all modifications and alternative forms falling within the spirit and scope of the invention.

I claim:

1. A method for providing a homogeneous mixture of plastic pellets and compounding additives for addition to a polymer molding or extruding process, comprising the steps of:

(a) providing a bag suitable for vacuum packaging;

(b) providing a substantially homogeneous mixture of a plurality of freely flowable plastic pellets and at least one selection from a group of freely flowable particles consisting of a plurality of second plastic pellets, plastic granules, plastic powders, compounding additive granules and compounding additive powders, wherein the freely flowable plastic pellets and the freely flowable particles differ from each other in at least one physical property selected from size, shape and specific gravity, that would result in their physical segregation due to settling to form an unhomogeneous mixture;

(c) introducing the homogeneous mixture into the bag;

(d) evacuating the bag of air and other gases to form a vacuum in the bag;

(e) sealing the evacuated bag, wherein the vacuum in the sealed bag prevents the physical segregation due to settling of the plurality of freely flowable pellets and freely flowable particles and maintains the homogeneity of the mixture for addition to a polymer molding or extruding process.

* * * * *